US005847339A

United States Patent [19]

Kurono et al.

[11] Patent Number: 5,847,339

[45] Date of Patent: Dec. 8, 1998

[54] HANDLE PORTIONS OF MULTIPOLE BREAKERS

[75] Inventors: Toru Kurono, Seto; Masakazu Saida, Nagoya; Hideaki Hayashi, Owariasahi, all of Japan

[73] Assignee: Nitto Electric Works, Ltd., Aichi-ken, Japan

[21] Appl. No.: 665,922

[22] Filed: Jun. 19, 1996

[30] Foreign Application Priority Data

Jun. 26, 1995 [JP] Japan ..... 7-158904

[51] Int. Cl.[6] ..... H01H 3/00; H01H 9/26

[52] U.S. Cl. ..... 200/18; 200/50.32; 200/401

[58] Field of Search ..... 200/17 R, 18, 200/50.11, 50.12, 50.26, 50.32, 315, 303–305, 339, 401; 335/8, 9, 10

[56] References Cited

U.S. PATENT DOCUMENTS

| | | | |
|---|---|---|---|
| 3,919,514 | 11/1975 | Strobel et al. | 200/331 |
| 4,307,359 | 12/1981 | Schultz et al. | 335/23 |
| 4,843,359 | 6/1989 | Morris et al. | 335/6 |
| 4,849,725 | 7/1989 | Nakano et al. | 335/8 |
| 5,302,787 | 4/1994 | Edds et al. | 200/401 |

OTHER PUBLICATIONS

JIS C8370 (published 1991), (Japanese Industrial Standard), published by Japanese Standards Association, Japan.

JIS C8370 (published 1986), (Japanese Industrial Standard) Molded Case Circuit Breakers (MCCB), translated and published by Japanese Standards Association, Japan.

*Primary Examiner*—Michael L. Gellner
*Assistant Examiner*—Michael J. Hayes
*Attorney, Agent, or Firm*—Frishauf, Holtz, Goodman, Langer & Chick

[57] ABSTRACT

A handle portion of a multipole breaker includes a handle main body, made of an insulating material, for ON/OFF operation of the multipole breaker. Movable fingers having respective movable contacts are provided for opening and closing of respective circuits, and a connecting section is interposed between the handle main body and the movable fingers for transmitting ON/OFF operation of the handle main body to the movable fingers. The connecting section has at upper positions thereof one of: (i) openings for receiving shafts formed on side walls and a center wall of a breaker case, and (ii) shafts to be fitted in recesses defined in the side walls and the center wall of the breaker case. In addition, the handle main body has, on a bottom portion thereof, a partition for insulating adjacent poles.

12 Claims, 9 Drawing Sheets

HANDLE PORTIONS OF MULTIPOLE BREAKERS

BACKGROUND OF THE INVENTION

1. Field of the Invention

The present invention relates to a handle portion of a multicircuit breaker, particularly to a handle portion applicable to a molded case circuit breaker as specified in JIS (Japanese Industrial Standard) C 8370 (published 1991) which operates to open and close two or more circuits simultaneously.

2. Description of the Related Art

Recently, a multipole breaker fabricated by incorporating two breaker mechanisms for two poles into a case having the same dimensions as in the single-pole molded case circuit breaker for lighting distribution board specified in Annex 5 of JIS C8370 (published 1991) has been developed. In such a multicircuit breaker, the handle portion generally includes of a handle main body, pivotal shafts protruding from each side of the handle main body and a forked lower end portion, extended below the pivotal shafts, for pivotally supporting movable fingers. Conventionally, these elements have all been molded integrally using the same insulating material. Further, provided that a handle for performing on/off operation between movable contacts and fixed contacts for two or more circuits is defined as "a common handle main body", the common handle main body is made of an insulating material, and metallic movable fingers are attached to the tines of the forked lower end portion respectively so that the two circuits may function independently.

FIG. 9 shows a structure of the handle portion of a conventional multipole breaker. As shown in FIG. 9, conventionally, a common handle main body 51, which is made of an insulating material, has a pair of short pivotal shafts 52, on each side, integrally molded therewith so as to be supported between side walls 53 of a case, and also a forked lower end portion 56 having two pairs of tines. These pivotal shafts 52 are fitted in pits 54 defined on the inner surfaces of side walls 53 to support the handle main body 51 at two points. However, since metallic movable fingers 55 must be pivotally attached to the forked lower end portion 56 such that each movable finger 55 may nip a pair of tines of the forked lower end portion 56 therebetween, these tines should be thin. Thus, if the conventional breaker mechanisms are attempted to be accommodated within specified outer dimensions, the strength of the tines of the forked lower end portion 56 tends to be insufficient.

SUMMARY OF THE INVENTION

It is an objective of the present invention to overcome the problems described above. In order to attain the intended objective, the present invention provides a handle portion of a multipole breaker, in which a handle main body suffers no insufficiency in strength and can be pivotally supported stably in a case free from backlash in movable fingers, and which can securely achieve electrical insulation between circuits.

The handle portion of a multipole breaker according to the present invention is characterized in that between the handle main body made of an insulating material and the movable fingers are interposed connecting means for connecting the handle main body with the movable fingers, and in that the connecting means has at upper positions openings for receiving shafts formed on side walls and a center wall of a case or has shafts to be fitted in openings for receiving shafts defined in the side walls and the center wall of the case. Further, the handle portion of the multipole breaker according to the present invention is provided with engaging means on the bottom of the handle main body.

Further, the engaging means in the handle portion of the multipole breaker according to the present invention comprises grooves and members to be engaged with them, and the lower bottom surface portions lower than these grooves are formed asymmetrically so as to restrict the direction in which the members are inserted.

The handle portion of the multipole breaker according to the present invention also has a partition formed on the bottom of the handle main body at the center. This partition achieves insulation between adjacent circuits.

The partition in the handle portion of the multipole breaker according to the present invention may be offset to one side of a center wall, interposed between the circuits, to extend along one lateral surface of the center wall.

As described above, since the handle portion of the multipole breaker according to the present invention is supported in the case via the connecting means, thin portions like the forked lower end portion 56 in the prior art handle main body 51, as shown in FIG. 9, can be eliminated.

Further, since the handle portion according to the present invention is also supported by the shafts or shaft-receiving openings formed on the side walls and/or the center wall, mechanical strength can be improved.

In addition, in the handle portion of the multipole breaker according to the present invention, the connecting means are inserted in the grooves of the handle main body toward the partition for insulating the circuits from each other formed on the handle main body. Accordingly, there is virtually no chance that the connecting means will slip off the handle main body, and a distance for insulation between the circuits can be secured easily.

Furthermore, since the circuit insulating partition in the handle portion of the multipole breaker according to the present invention is offset to one side from the center line of the handle main body to extend along one lateral surface of the center wall, insulating performance between the circuits can be greatly improved, and the center wall can secure sufficient strength.

Such constitution can facilitate incorporation of the connecting means into the handle main body in a breaker assembly. After assembly, there is virtually no chance that the connecting means will slip off the handle main body. Further, since the connecting means and the handle main body can be positioned free from backlash, there occurs no trouble whereby the handle main body comes into contact with the case to increase operation load. Moreover, since the circuit insulating partition is provided on the bottom of the handle main body, the insulating property of the handle portion can be improved. Incidentally, in this embodiment, the connecting means are slide-fitted from each side of the handle main body, because the breaker of the embodiment is of a two-circuit structure. However, in the case of a breaker for operating three or more circuits, at least connecting means for outer circuits are fitted from each side toward the partition.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENT

The handle portion of a multipole breaker according to the present invention will be described below in more detail by way of a preferred embodiment.

FIGS. 1 to 8 illustrate a two-circuit breaker according to one embodiment of the present invention. The embodiment of the present invention will be described referring to FIGS. 1 to 3.

A case comprises a pair of side walls 1, a center wall 2 and breaker mechanisms incorporated on each side of the center wall 2. The breaker mechanisms function in the same manner as those in the conventional circuit breaker.

A handle main body 3, which is made of an insulating material and operates the circuits in common, is provided with engaging grooves 4 defined on the bottom. These grooves 4 extend orthogonal to the direction in which the handle main body 3 is switched.

Figure 1:
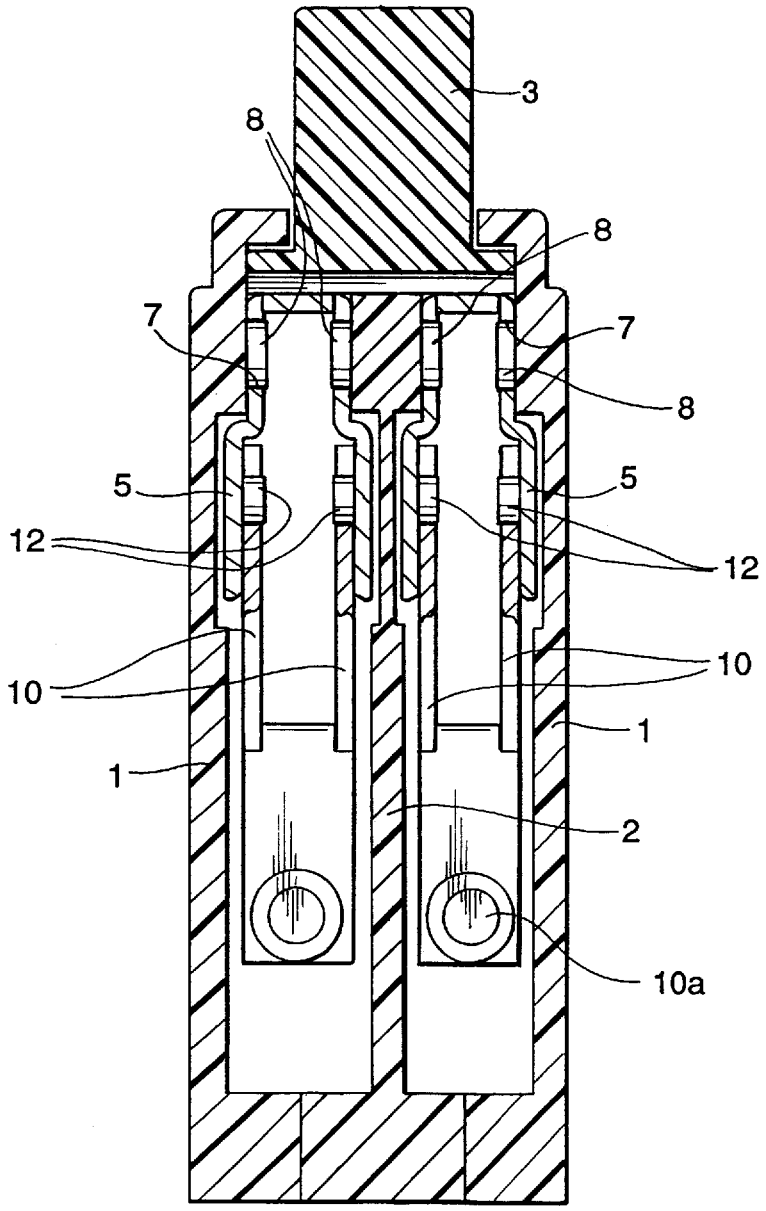
FIG. 1 is a partial cross-sectional view according to one embodiment of the present invention.
Figure 2:
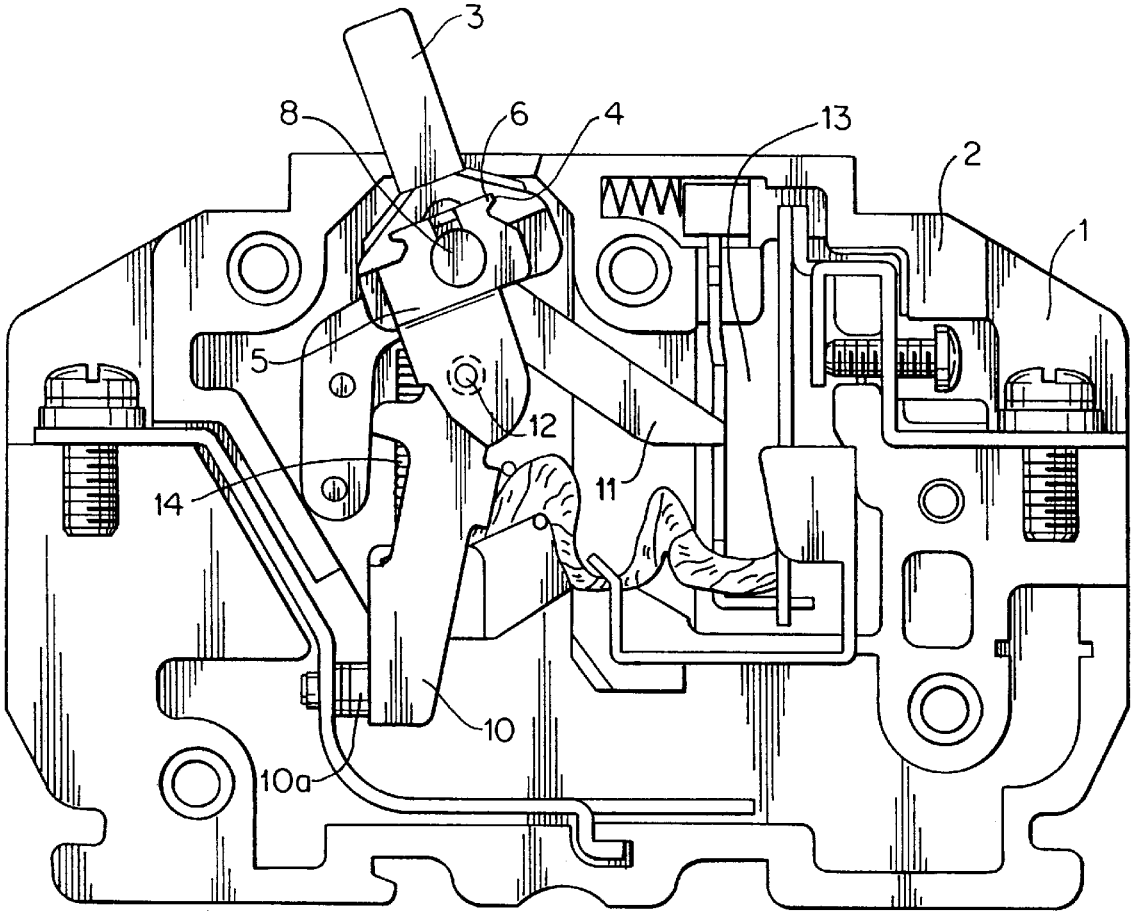
FIG. 2 is a side view with the right side cover 1 removed, showing the internal structure of the embodiment shown in FIG. 1.
Figure 3:
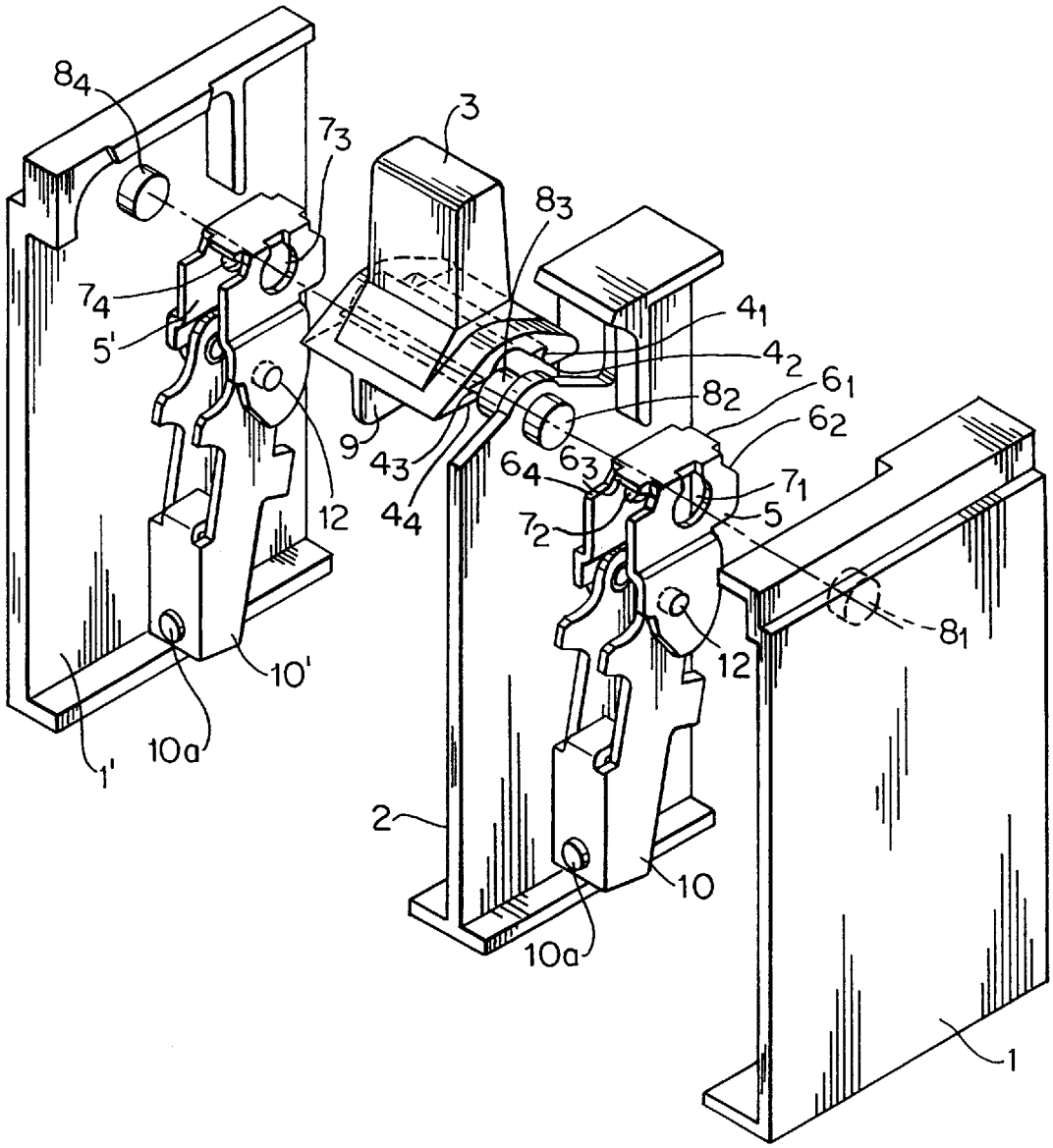
FIG. 3 is an exploded perspective view of the embodiment shown in FIG. 1.

As shown in FIGS. 2 and 3, each mechanical connecting section 5 serving as connecting means has protrusions 6 protruding horizontally from the upper side edges in the handle-switching direction. These protrusions 6 are designed to be inserted to the engaging grooves 4. The mechanical connecting sections 5 combine movable fingers 10 having movable contacts 10*a* with the handle main body 3 and are pivotally supported between the side walls 1 of the case.

Figure 4:
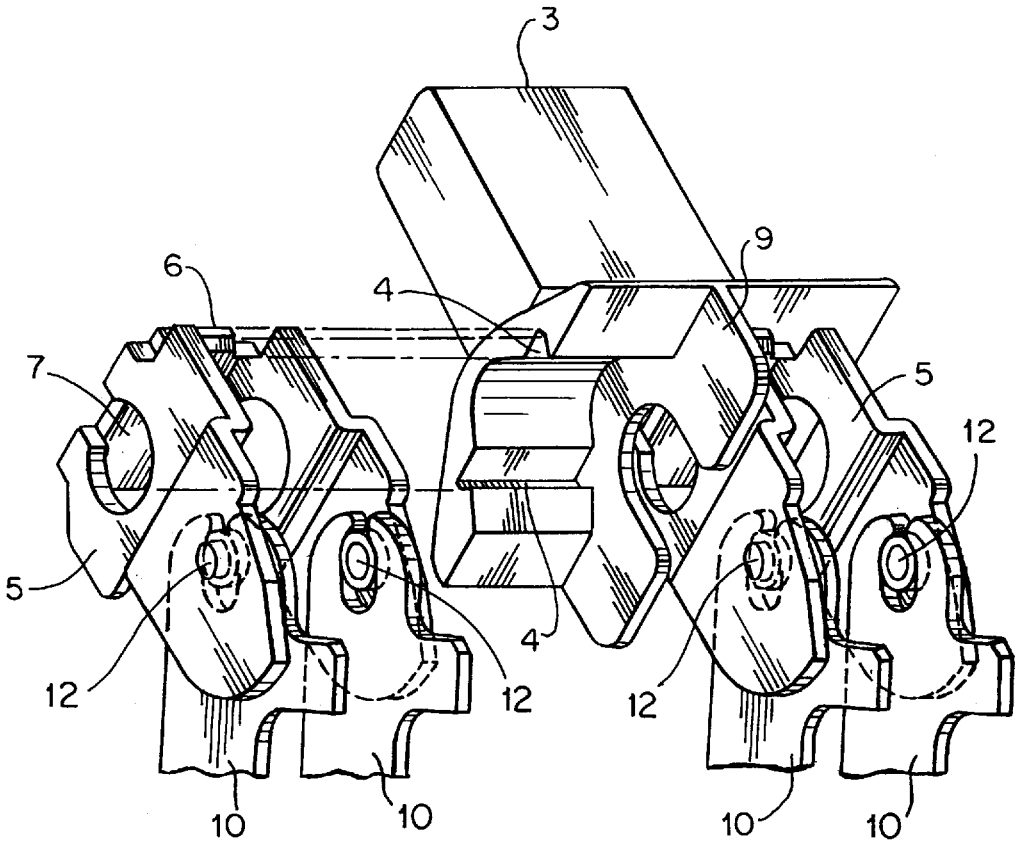
FIG. 4 is an exploded perspective view showing how the handle main body, connecting means and movable fingers are connected in the embodiment shown in FIG. 1.

As shown in FIGS. 3 and 4, the mechanical connecting sections 5 are each formed by bending a metal plate to have an inverted U-shape with protrusions 6 being formed along the upper side edges of the top plate. Inner and outer lateral members of each mechanical connecting section 5 each contain a shaft-receiving opening 7 (hereinafter simply referred as an opening 7), near the upper ends, in which shafts 8 formed on each side of the center wall 2 and on the inner surface of the side walls 1 are fitted. With respect to these shafts 8 and shaft-receiving holes 7, shafts 8 may be formed on the mechanical connecting sections 5, and shaft-receiving recesses may be defined on each side of the center wall 2 and on the inner surfaces of the side walls 1.

The mechanical connecting sections 5 are preferably made of a metallic material such as iron and brass or a nonmetallic material such as a fiber glass reinforced plastic (FRP). The mechanical connecting sections 5 may have other forms than the inverted U-shape. For example, the top plates of the inverted U-shaped mechanical connecting sections 5 may be omitted to allow only the lateral members thereof to serve as mechanical connecting sections and to sandwich each movable finger 10 between each pair of mechanical connecting sections. In this case, the four mechanical connecting sections are fixed to the handle main body 3 independently. Otherwise, one lateral member in each pair of mechanical connecting sections 5 may be further omitted to support each movable finger 10 by a single mechanical connecting section. In this case, two mechanical connecting sections are fixed to the handle main body 3 independently.

The handle main body 3 is disposed above the center wall 2, and the protrusions 6 formed along the upper edges of the mechanical connecting sections 5 to which a cradle 11 (to be described later) and the movable fingers 10 are incorporated are fitted in the grooves 4 (the grooves $\mathbf{4}_1$ and $\mathbf{4}_3$ in FIG. 3) defined on the bottom of the handle main body 3 on each side to extend orthogonally to the handle-switching direction.

As shown in FIGS. 3 and 4, the protrusions 6 of the mechanical connecting sections 5 are slide-fitted inward from each side into the engaging grooves 4, and thus the mechanical connecting sections 5 are integrated into the handle main body 3. Further, these engaging grooves 4 are of different profiles, i.e. the profile of the engaging groove $\mathbf{4}_1$,$\mathbf{4}_2$ portion is different from that of the engaging groove portion $\mathbf{4}_3$,$\mathbf{4}_4$. In this embodiment, the bottom surface portion of the handle main body 3 located lower than one groove 4 is tapered to conform to the profile of the chipped upper corners on one side of the lateral members of each mechanical connecting section 5, whereas the bottom surface portion located lower than the other groove 4 is formed horizontally to conform to the profile of the chipped upper corners on the other side of the lateral members of each mechanical connecting section 5.

More specifically, the upper corners of each lateral member in each mechanical connecting section 5 are chipped off to have different profiles from each other. The profile of the chipped upper corner $\mathbf{6}_2$ located below one protrusion $\mathbf{6}_1$ is formed to conform to the bottom surface portion $\mathbf{4}_2$ lower than one groove $\mathbf{4}_1$ (tapered in this embodiment), whereas that of the other chipped upper corner $\mathbf{6}_4$ located below the other protrusion $\mathbf{6}_3$ is formed to conform to the bottom surface portion $\mathbf{4}_4$ lower than the other groove $\mathbf{4}_3$ (horizontally in this embodiment), respectively.

The difference in the profile of the chipped upper corners 4 located below the protrusions 6 formed on each upper side edge of each mechanical connecting section 5 allows insertion of these protrusions 6 in proper postures into the grooves 4 of the handle main body 3, and thus the mechanical connecting sections 5 can be securely fixed to the handle main body 3.

The openings 7 defined in the lateral members of the mechanical connecting sections 5 are of the same shape and are aligned on the same axis. Shafts 8 are formed to protrude from the side walls 1 and the center wall 2, and these shafts 8 are fitted in the openings 7 defined in the mechanical connecting sections 5 respectively.

In FIG. 3, the shaft $8_1$ of the side wall 1 is inserted to the opening $7_1$ of the mechanical connecting section 5, while the shaft $8_2$ of the center wall 2 is inserted to the opening $7_2$ of the mechanical connecting section 5. Likewise, the shaft $8_4$ of the side wall 1' is inserted to the opening $7_4$ of the mechanical connecting section 5', while the shaft $8_3$ of the center wall 2 is inserted to the opening $7_3$ of the mechanical connecting section 5'. Alternatively, shaft-receiving recesses may be defined in the center wall and on the side walls, and shafts may be formed on the mechanical connecting sections 5.

Figure 5:
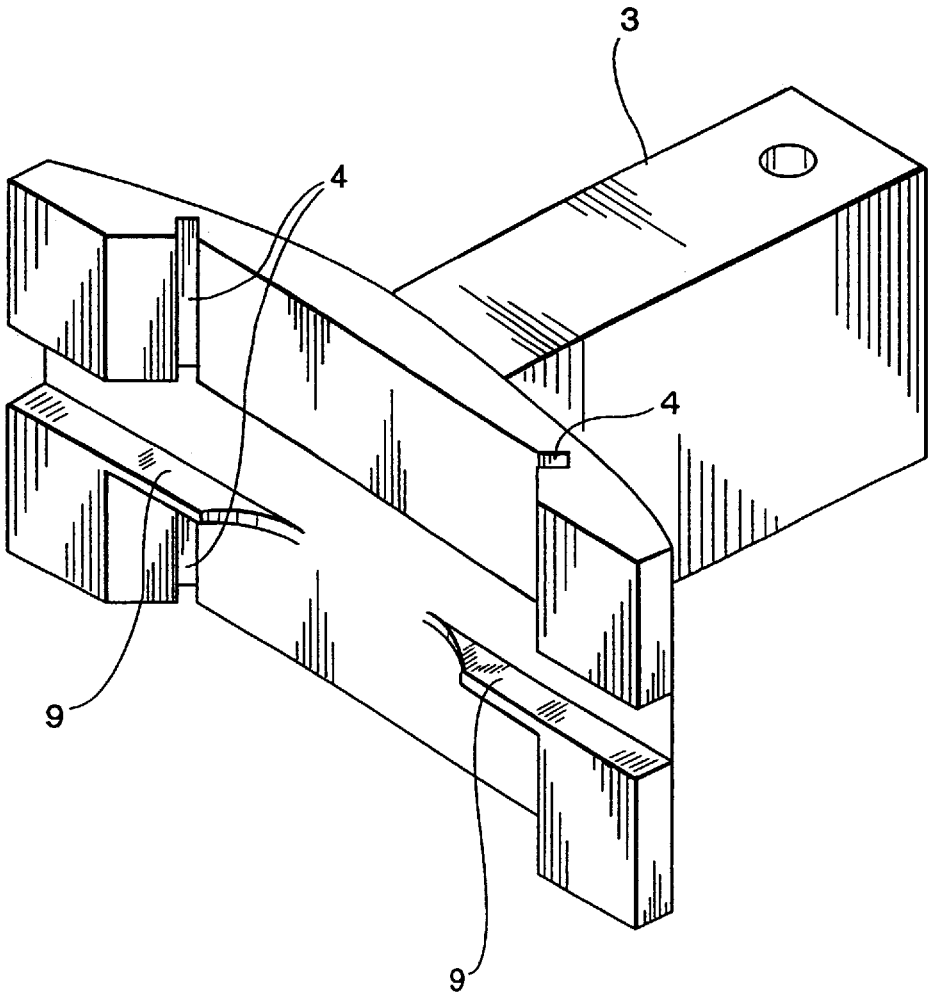
FIG. 5 is a perspective bottom view of the handle main body according to the embodiment shown in FIG. 1.
Figure 6:
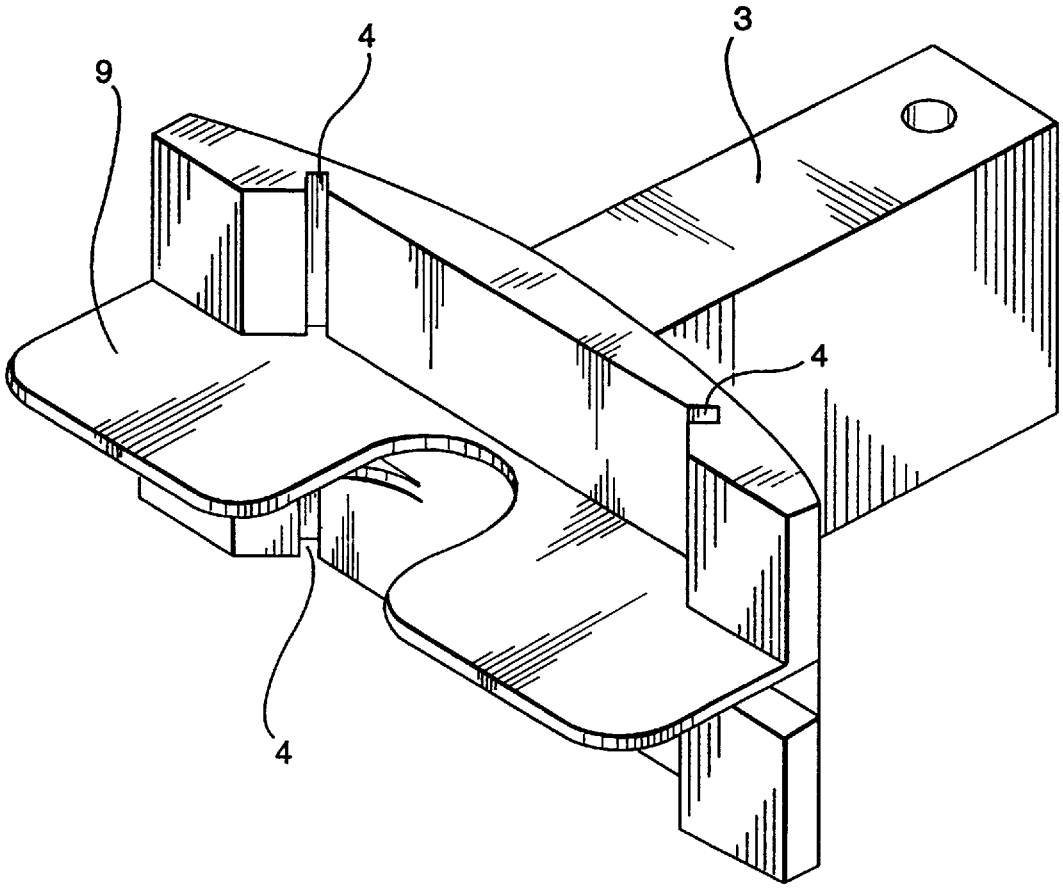
FIG. 6 is also a perspective bottom view showing a variation of the handle main body.

As shown in FIGS. 4, 5 and 6, a partition 9 for insulating the circuits from each other is formed on the bottom of the handle main body 3.

The metallic mechanical connecting sections 5 are inserted into the engaging grooves 4 from each side toward the circuit insulating partition 9 protruding from the bottom of the handle main body 3. This partition 9 electrically insulates the metallic mechanical connecting sections 5, disposed on each side thereof, from each other.

A movable finger 10 is connected to each mechanical connecting section 5. As shown in FIG. 4, shafts 12 are formed on each lateral member of the mechanical connecting sections 5 at inner lower positions, and the movable fingers 10 have U-shaped upper portions. The U-shaped upper portions of the movable fingers 10 are pivotally engaged with the shafts 12 respectively. While the shafts 12 are formed on the mechanical connecting sections 5, they may be formed on the movable fingers 10, and shaft-receiving openings may be defined in the mechanical connecting sections 5.

In the thus constituted breaker, the handle portion is supported stably at four points via the shafts $8_1$, $8_2$, $8_3$ and $8_4$ formed on the side walls 1 and the center wall 2 respectively and the openings $7_1$, $7_2$, $7_3$ and $7_4$ defined in the mechanical connecting sections 5, respectively. On-off operation of the breaker can be achieved by switching the handle main body 3 integrated with the mechanical connecting sections 5. The movable fingers 10 are pivotally attached to the lower end portions of the mechanical connecting sections 5, while the upper portion of each mechanical connecting section 5 is pivotally supported by the shafts 8 fitted in the openings 7 defined therein.

An arcuate cradle 11, for imparting instant opening function etc. is provided with a trigger plate 13, with which the distal end portion of the cradle 11 is engaged, and an extension spring 14 extended between the cradle 11 and the movable fingers 10 substantially at the middle respectively (see FIG. 2). When the handle main body 3 in the OFF state is switched, the handle main body 3 integrated with the mechanical connecting sections 5 and the movable fingers 10 together assuming a "<" -shape then assume an I-shape against the force of the spring and further assumes at once a ">" -shape under the force of the spring to bring the contacts 10*a* of the movable fingers 10 into contact with fixed contacts respectively to close the circuits (ON state). Incidentally, the actions of the breaker mechanism such as those of the movable fingers, trigger plate, cradle, spring, etc. are the same as in the prior art circuit breaker.

Figure 9:
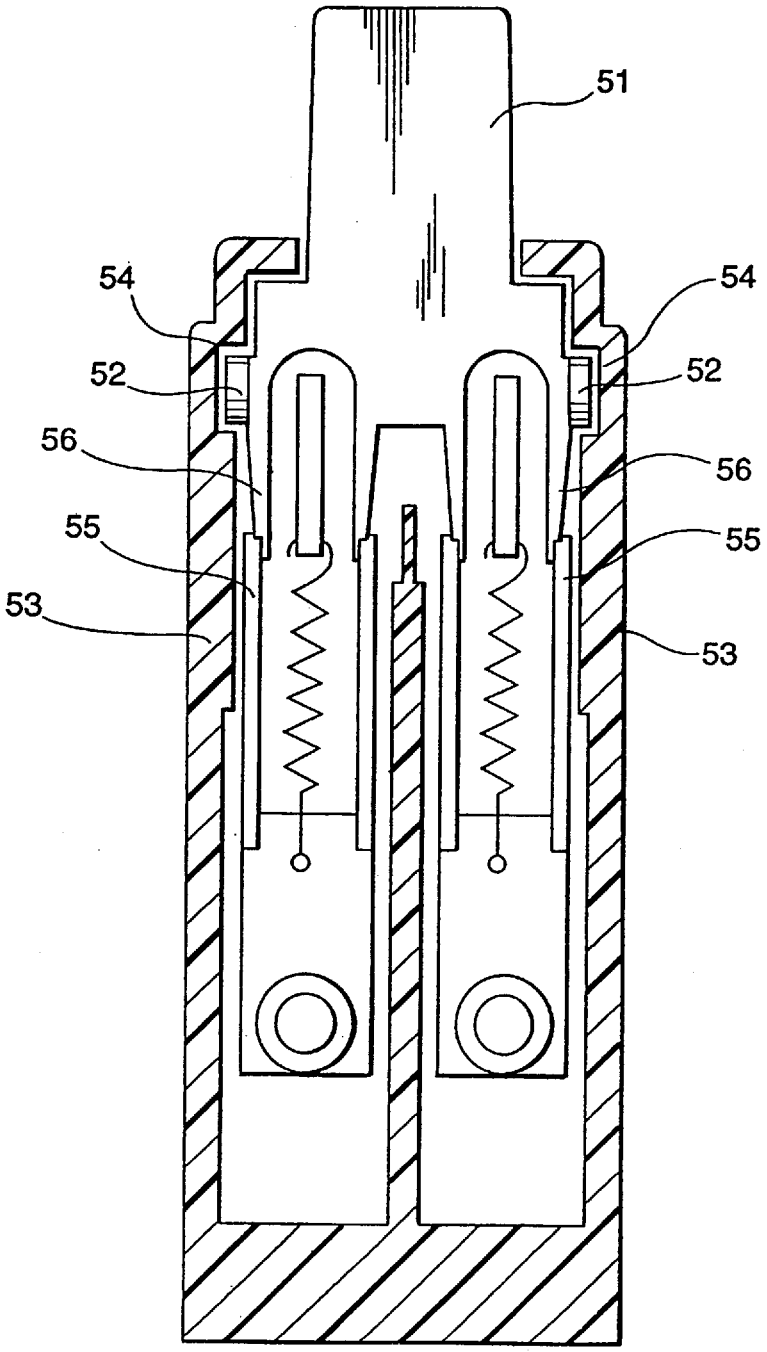
Fig. 9 (PRIOR ART)
FIG. 9 is a partial cross-sectional view of a prior art embodiment.

According to the present invention, since the mechanical connecting sections 5 are integrated into the handle main body 3 and the shafts 8 formed on the side walls 1 and the center wall 2 are fitted in the openings 7 defined in the mechanical connecting sections 5, the handle main body 3 can be supported between the side walls 1 of the case via the mechanical connecting sections 5. Thus, mechanical strength of the handle main body 3 can be improved advantageously as compared with the prior art handle main body having thin portions with insufficient strength, as shown in FIG. 9.

FIG. 4 shows the major portion of the embodiment of the present invention. As shown in FIG. 4, since the mechanical connecting sections 5 are integrated into the handle main body 3 by fitting the protrusions 6 formed at the upper edges of each mechanical connecting section 5 in two engaging grooves 4 defined on each side on the bottom of the handle main body 3 to be orthogonal to the handle-switching direction, there is virtually no chance that the mechanical connecting sections 5 will slip off the handle main body 3. Further, the mechanical connecting sections 5 and the handle main body 3 can be positioned free from backlash, so that there occurs no trouble whereby the handle main body 3 comes into contact with the case to increase operation load.

In the foregoing embodiment, a pair of mechanical connecting sections 5 for two circuits are attached to the lower end portion of the handle main body 3. Each mechanical connecting section 5 is formed by bending a metal plate into an inverted U-shape, as shown in FIGS. 3, 4 and 7, and these two mechanical connecting sections 5 can be operated simultaneously by switching the handle main body 3.

As shown in FIGS. 3 and 4, the inner lateral member and the outer lateral member of each mechanical connecting section 5 each contain an opening 7 near the upper end. These openings 7 are of the same shape and are aligned on the same axis. The shafts 8 formed on each side of the center wall 2 are fitted in the openings 7 of the inner lateral members of the mechanical connecting sections 5 to sandwich the center wall 2 between these inner lateral members. The side walls 1 are applied on each side of the center wall 2 to fit the shafts 8 formed on the inner surfaces of the side walls 1 into the openings 7 defined in the outer lateral members of the mechanical connecting sections 5, with breaker mechanisms for the respective circuits being incorporated into two spaces defined by these two side walls 1 and the center wall 1, respectively. This handle main body 3 is pivotally supported in the case via the mechanical connecting sections 5 at four points $7_1$-$8_1$, $7_2$-$8_2$, $7_3$-$8_3$ and $7_4$-$8_4$, and the mechanical connecting sections for two circuits integrated with the handle main body 3 can be operated simultaneously by switching the handle main body 3.

As shown in FIGS. 5 and 6, the circuit insulating partition 9 provided at the bottom of the handle main body 3 improves insulating property of the handle portion. Incidentally, in this embodiment, the mechanical connecting sections 5 are slide-fitted from each side of the handle main body 3, because the breaker of this embodiment is of a two-circuit structure. However, in the case of a breaker for operating three or more circuits, at least mechanical connecting sections 5 for outer circuits are fitted from each side toward the partition 9.

Figure 7:
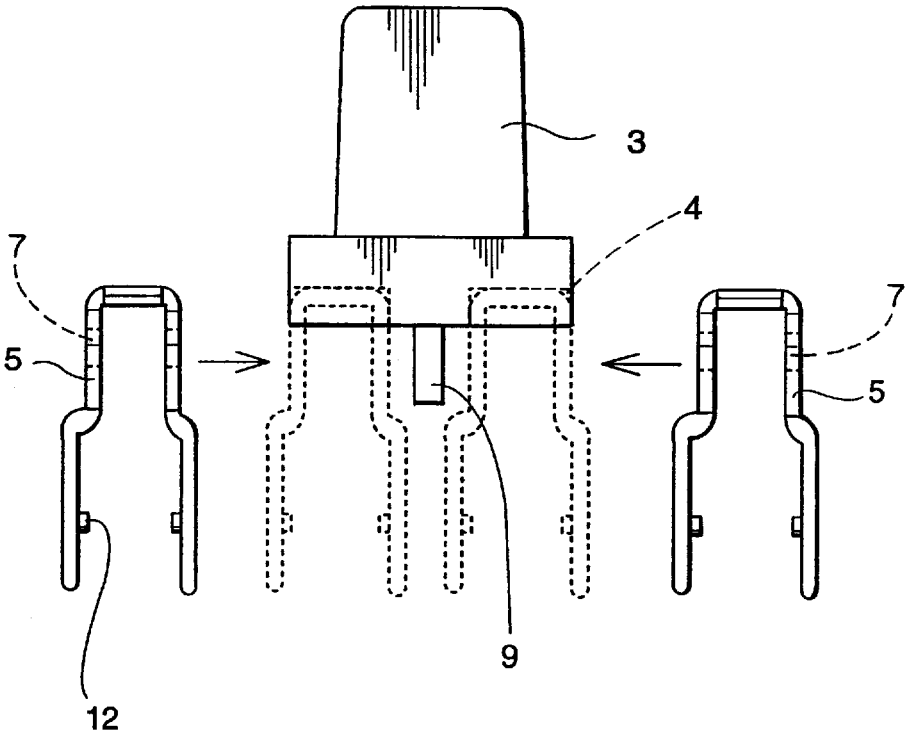
FIG. 7 is a view for explaining how the connecting means are inserted to grooves defined on the handle main body toward a partition.
Figure 8:
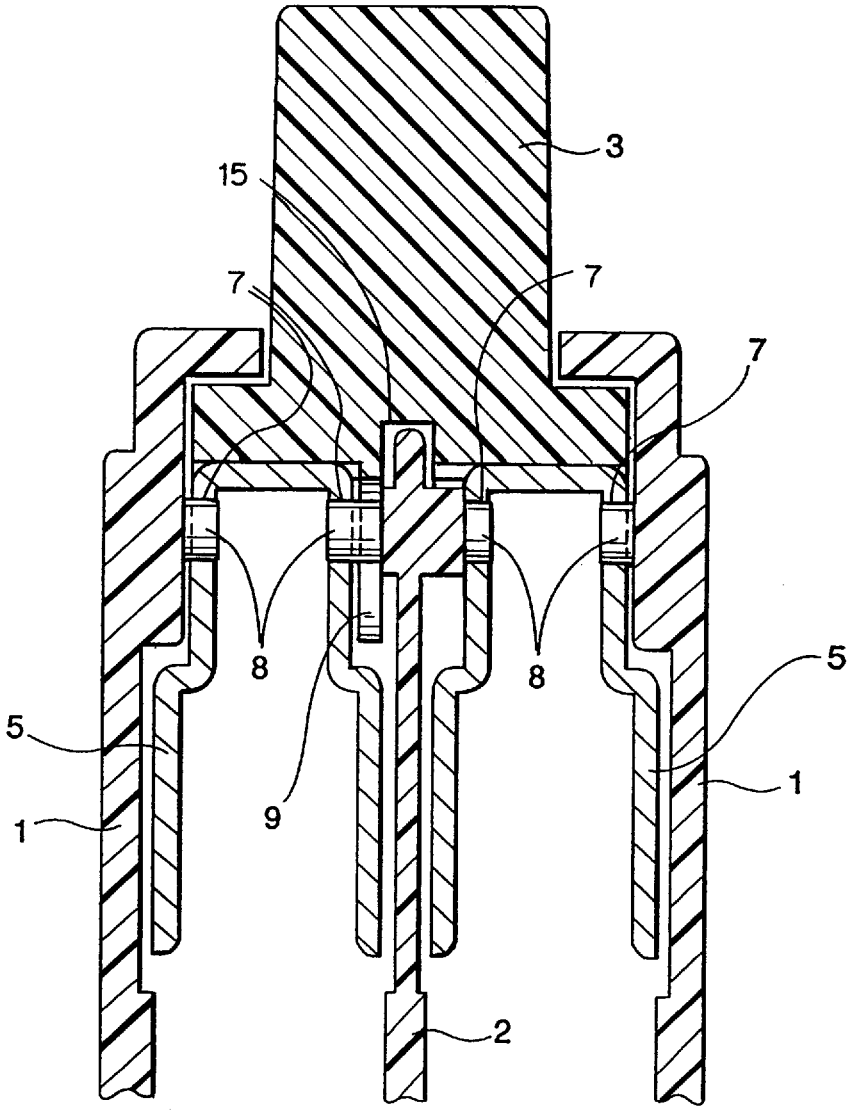
FIG. 8 is a partial cross-sectional front view of the handle main body according to the embodiment of the present invention, showing an elongated surface distance for insulation defined by the partition and a wide groove formed on the bottom of the handle main body.

FIGS. 7 and 8 show examples of the partition 9 according to the present invention. In FIG. 7, the partition 9 is formed at the center of the bottom of the handle main body 3.

The circuit insulating partition 9 may be formed on the bottom of the handle main body 3 to offset toward one side from the center line thereof, as shown in FIG. 8, such that the circuit insulating partition 9 may extend along one lateral surface of the center wall 2 when the handle main body 3 is incorporated into the case. Meanwhile, a groove 15 which is wider than the thickness of the center wall 2 is defined on the bottom of the handle main body 3 along the center line thereof, so that the upper end portion of the center wall 2 may be fitted in this groove 15. Thus, sufficient distance for insulation can be secured between the mechanical connecting sections 5 for the respective circuits integrated into the handle main body 3.

More specifically, the partition 9 and the wide groove 15 comprise an insulating member which provides an elongated surface distance for insulation, and the insulating member shown in FIG. 8 provides a very high insulating property a compared with the partition 9 shown in FIG. 7. The term "elongated surface distance for insulation" referred to herein means the minimum distance that leakage can occur, between bare live parts and other parts to be insulated therefrom, along the surface of an insulating material.

As has been described heretofore, according to the present invention, since the handle main body 3 is securely supported in the case via the openings $\mathbf{7}_1$, $\mathbf{7}_2$, $\mathbf{7}_3$ and $\mathbf{7}_4$ of the mechanical connecting sections 5 and the shafts $\mathbf{8}_1$, $\mathbf{8}_2$, $\mathbf{8}_3$ and $\mathbf{8}_4$ of the side walls 1 and center wall 2 at the four points respectively, the handle portion can be held stably in the case free from insufficiency in the strength thereof and free from backlash in the mechanical connecting sections 5.

Furthermore, since the metallic mechanical connecting sections 5 are fitted on each side of the circuit insulating partition 9 formed on the handle main body 3 or of the insulating member formed by the partition 9 and the wide groove 15 such that the partition 9 and the like may be sandwiched between the mechanical connecting sections 5, the handle main body 3 can be retained stably in the case free from backlash in these sections 5. In addition, the partition 9 or the wide groove 15 can ensure insulation between the circuits.

In addition, since the circuit insulating partition 9 is located on the bottom of the handle main body 3 offset to one side from the center line thereof, the partition 9 provides an elongated surface distance for insulation to further ensure insulation between the circuits.

Since the upper portion of the center wall 2 is designed to be fitted in the wide groove 15, which is wider than the thickness of the center wall 2, defined on the bottom of the handle main body 3 along the center line thereof, the handle main body 3 and the center wall 2 can be securely fitted to each other to cause no backlash in the mechanical connecting sections 5.

Although only one embodiment of the present invention has been described herein, it should be apparent to those skilled in the art that the present invention may be embodied in many other specific forms without departing from the spirit or scope of the invention. Therefore, the present examples and embodiment are to be considered as illustrative and not restrictive, and the invention is not to be limited to the details given herein, but may be modified within the scope of the appended claims.

What is claimed is:

1. A handle portion of a multipole breaker comprising connecting means interposed between a handle main body, which controls ON/OFF operation, and movable fingers, wherein:

said connecting means transmits ON/OFF operation of said handle main body to said movable fingers;

said handle main body is made of an insulating material;

said movable fingers have respective movable contacts; and said handle main body has, on a bottom portion thereof, a partition for insulating adjacent poles.

2. The handle portion of a multipole breaker according to claim 1, wherein said connecting means is fitted sideways into an engaging groove slidably toward said insulating partition.

3. The handle portion of a multipole breaker according to claim 1, wherein said partition is offset to one side of a center wall of a breaker case, interposed between circuits, to extend along one lateral surface of said center wall.

4. The handle portion of a multipole breaker according to claim 1, wherein:

said connecting means is fitted sideways into an engaging groove slidably toward said insulating partition; and said partition is offset to one side of a center wall of a breaker case, interposed between circuits, to extend along one lateral surface of said center wall.

5. The handle portion of a multipole breaker according to claim 1, wherein:

said partition is offset to one side of a center wall of a breaker case, interposed between circuits, to extend along one lateral surface of said center wall; and said bottom portion of said handle main body has a wide groove, which is wider than a thickness of said center wall, in which an upper end portion of said center wall is fitted, to secure an elongated surface distance for insulation by said partition and said wide groove.

6. The handle portion of a multipole breaker according to claim 1, wherein:

said connecting means is fitted sideways into an engaging groove slidably toward said insulating partition;

said partition is offset to one side of a center wall of a breaker case, interposed between circuits, to extend along one lateral surface of said center wall; and said bottom portion of said handle main body has a wide groove, which is wider than a thickness of said center wall, in which an upper end portion of said center wall is fitted, to secure an elongated surface distance for insulation by said partition and said wide groove.

7. A handle portion of a multipole breaker, said handle portion comprising:

a handle main body, made of an insulating material, for ON/OFF operation of said multipole breaker;

movable fingers having respective movable contacts for opening and closing of respective circuits; and a connecting section interposed between said handle main body and said movable fingers for transmitting ON/OFF operation of said handle main body to said movable fingers;

wherein said connecting section has at upper positions thereof one of: (i) openings for receiving shafts formed on side walls and a center wall of a breaker case, and (ii) shafts to be fitted in recesses defined in said side walls and said center wall of said breaker case; and wherein said handle main body has, on a bottom portion thereof, a partition for insulating adjacent poles.

8. The handle portion of a multipole breaker according to claim 7, wherein said connecting section has at lower positions thereof shafts for pivotally supporting said movable fingers.

9. The handle portion of a multipole breaker according to claim 7, wherein said bottom portion of said handle main body is connected to one end of said connecting section through an engaging mechanism.

10. The handle portion of a multipole breaker according to claim 7, wherein:

said connecting section has at lower positions thereof shafts for pivotally supporting said movable fingers, and said bottom portion of said handle main body is connected to one end of said connecting section through an engaging mechanism.

11. The handle portion of a multipole breaker according to claim 7, wherein:

said bottom portion of said handle main body is connected to one end of said connecting section through an engaging mechanism comprising a pair of grooves defined on said bottom portion of said handle main body, and bottom surface portions located lower than said grooves are formed asymmetrically so as to restrict a direction in which said connecting section is insertable.

12. The handle portion of a multipole breaker according to claim 7, wherein:

said connecting section has at lower positions thereof shafts for pivotally supporting said movable fingers, said bottom portion of said handle main body is connected to one end of said connecting section through an engaging mechanism comprising a pair of grooves defined on said bottom portion of said handle main body, and bottom surface portions located lower than said grooves are formed asymmetrically so as to restrict a direction in which said connecting section is insertable.

* * * * *